US007916838B2

(12) United States Patent
Perkins et al.

(10) Patent No.: US 7,916,838 B2
(45) Date of Patent: Mar. 29, 2011

(54) BETATRON BI-DIRECTIONAL ELECTRON INJECTOR

(75) Inventors: Luke T. Perkins, Plainsboro, NJ (US); Christian Stoller, Princeton Junction, NJ (US); Sicco Beekman, Lawrenceville, NJ (US)

(73) Assignee: Schlumberger Technology Corporation, Cambridge, MA (US)

( * ) Notice: Subject to any disclaimer, the term of this patent is extended or adjusted under 35 U.S.C. 154(b) by 510 days.

(21) Appl. No.: 11/957,228

(22) Filed: Dec. 14, 2007

(65) Prior Publication Data

US 2009/0153079 A1 Jun. 18, 2009

(51) Int. Cl.
*H05G 1/52* (2006.01)

(52) U.S. Cl. ..... 378/113; 378/101; 378/121; 378/93; 378/92

(58) Field of Classification Search ..... 315/504, 315/501, 502, 503, 505, 507, 500; 378/121–125, 378/101, 113, 103–107, 92, 93
See application file for complete search history.

(56) References Cited

U.S. PATENT DOCUMENTS

| | | | |
|---|---|---|---|
| 3,321,625 | A | 5/1967 | Wahl |
| 3,975,689 | A | 8/1976 | Geizer et al. |
| 3,996,473 | A | 12/1976 | Culver |
| 4,577,156 | A | 3/1986 | Kerst |
| 4,823,044 | A | 4/1989 | Falce |
| 5,077,530 | A | 12/1991 | Chen |
| 5,122,662 | A | 6/1992 | Chen et al. |
| 5,293,410 | A | 3/1994 | Chen et al. |
| 5,319,314 | A | 6/1994 | Chen |
| 5,426,409 | A | 6/1995 | Johnson |
| 5,525,797 | A | 6/1996 | Moake |
| 5,745,536 | A | 4/1998 | Brainard et al. |
| 5,804,820 | A | 9/1998 | Evans et al. |
| 5,912,460 | A | 6/1999 | Stoller et al. |
| 6,121,850 | A | 9/2000 | Ghoshal |
| 6,201,851 | B1 | 3/2001 | Piestrup et al. |
| 6,441,569 | B1 | 8/2002 | Janzow |
| 6,713,976 | B1 | 3/2004 | Zumoto et al. |
| 6,925,137 | B1 | 8/2005 | Forman |
| 7,148,613 | B2 | 12/2006 | Dally et al. |
| 2006/0261759 | A1 | 11/2006 | Chen et al. |
| 2009/0072767 | A1 * | 3/2009 | Ernst ..... 315/504 |

OTHER PUBLICATIONS

Ellis et al., Well Logging for Earth Scientists, Springer, 2nd edition, 2007, pp. 345-379.

* cited by examiner

*Primary Examiner* — Tuyet Thi Vo
(74) *Attorney, Agent, or Firm* — James McAleenan; Vincent Loccisano; Brigid Laffey

(57) ABSTRACT

A Betatron having a toroidal passageway disposed in a cyclical magnetic field with a main electron orbit circumnavigating the toroidal passageway. Within the toroidal passageway is a first electrode that is spaced apart from a second electrode. The combination of the first electrode and the second electrode define a central space having a first opening and a second opening. A cathode is disposed within the central space. This cathode has a first electron emitter aligned to inject electrons through the first opening and a second electron emitter aligned to inject electrons through the second opening. Electrons injected in a proper direction are accelerated in the main electron orbit. At a time of maximum electron acceleration, the electrons are deflected and impact a target that generates x-rays on impact.

25 Claims, 7 Drawing Sheets

TWO-SIDED CARBON NANOTUBES EMITTER

COLD CATHODE EMITTER W/DOUBLE SIDE CONSTRUCTION

BETATRON BI-DIRECTIONAL ELECTRON INJECTOR

CROSS REFERENCE TO RELATED APPLICATION(S)

This patent application is related to commonly owned U.S. patent application Ser. No. 11/957,183, to Luke T. Perkins, titled "Bi-Directional Dispenser Cathode", filed on Dec. 14, 2007.

BACKGROUND OF THE INVENTION

1. Field of the Invention

This invention generally relates to electron injectors, and more particularly to injectors that inject electrons in multiple directions into an evacuated passageway of a Betatron.

2. Background of the Invention

A Betatron is an electron accelerator that produces a high energy electron beam. If this beam is directed on a suitable target high energy x-rays are produced. Thus, the Betatron serves as a source of high energy x-rays. It operates by appropriately pulsing a magnetic field around an evacuated toroidal passageway having an interior volume that is periodically filled with electrons. The electrons are injected from the inner or outer diameter of the volume with some critical energy and are subsequently trapped into orbits dictated by the applied magnetic field and accelerated by the electromotive force (EMF) induced by the rapidly rising magnetic field.

Electron injection is typically timed to occur at the beginning of every acceleration cycle and aimed to accelerate electrons in one angular rotational direction. In some implementations of the Betatron the magnetic field is increased from a zero value to its maximum value and then returned to zero and this is repeated cyclically. In other applications the magnetic field is made to vary between a maximum positive and an equal opposite negative value. This affords to opportunities for injection during one full cycle. However, the second cycle having the opposite magnetic field the injection needs to be in the opposite direction. A standard injector is only capable of injecting in one direction, thus neglecting the opposite accelerating field that would be available in the second half cycle. Acceleration in alternate directions has been disclosed in Betatrons in the past, for example U.S. Pat. No. 4,577,156 to Kerst discloses two Betatron tubes, one above the other. Each tube has a separate electron injector and separate target. A first injector injects a beam of electrons into the first tube in a first direction when an accelerating flux is changing from its positive maximum to its negative maximum. The second injector then injects a beam of electrons into the second tube in an opposing second direction when the accelerating flux is changing from its negative maximum to its positive maximum. A single tube embodiment having two spaced apart injectors is also disclosed. U.S. Pat. No. 4,577,156 is incorporated by reference in its entirety herein.

There remains, a need for a single compact injector for a more efficient, compact, reliable and manufacturable system.

SUMMARY OF THE INVENTION

According to an embodiment of the invention, the invention has a Betatron including a toroidal passageway disposed in a cyclical magnetic field varying between a maximum positive value and an opposite negative value with a main electron orbit circumnavigating the toroidal passageway. The negative and positive amplitudes can be equal or very similar to assure that the energy of the accelerated electron beam is virtually the same in both directions. Within the toroidal passageway can be a first electrode that is spaced apart from a second electrode. The combination of the first electrode and the second electrode define a central space having a first opening that can be at one end and a second opening that can be at an opposing second end. However, it is noted that the first and second openings can be positioned in varying arrangements other than discussed above. A cathode can be disposed within the central space. This cathode has a first electron emitter aligned to inject electrons through the first opening and a second electron emitter aligned to inject electrons through the second opening. Electrons injected in the direction of the accelerating EMF are accelerated in the main electron orbit. At a time of maximum electron acceleration, the electrons are deflected and impact a target. The deceleration of the electrons in the target results in the emission of x-rays.

According to an embodiment of the invention, the invention includes a Betatron having a toroidal passageway disposed in a cyclical magnetic field with a main electron orbit circumnavigating said toroidal passageway. The invention further includes a first electrode spaced apart from a second electrode defining a central space having a first opening and a second opening. A cathode disposed within the central space such that a first electron emitter is aligned to inject electrons through the first opening and a second electron emitter is aligned to inject electrons through the second opening. The invention also includes a target effective to generate x-rays when impacted by accelerated electrons.

According to an aspect of the invention, the first electrode can be adjacent the main electron orbit and at ground voltage potential. Further, the second electrode can be at a voltage potential effective to deflect the injected electrons toward the main electron orbit.

According to an aspect of the invention, the cathode can be selected from the group consisting of a point electron source, a two-sided carbon nanotube emitter, a cold cathode emitter with double side construction and a bi-directional dispenser cathode. It is possible the cathode can be coupled to a high voltage power supply. Further, a high voltage power supply can be pulsed and the pulsing can be synchronized with the cyclical magnetic field. Further still, a switch can effectively enable the high voltage power supply to provide voltages to the bi-directional cathode at a selected time shortly after the cyclical magnetic field changes sign.

According to an aspect of the invention, a first suppression electrode can be proximate to the first opening and a second suppression electrode can be proximate to the second opening. It is possible the first suppression-deflection electrode and the second suppression-deflection electrode can be coupled to a power supply that is synchronized with the cyclical magnetic field. Also, one of the first suppression-deflection electrode and the second suppression-deflection electrode can be impressed with a voltage potential effective to suppress electrons injected through a proximate opening. Further still, the voltage from the high voltage supply can be constant during each half-cycle. The second electrode can have a first portion adjacent the first opening and a second portion adjacent the second opening and the first and second portions can be electrically isolated. Further, at each moment of time, only the one of the first portion and the second portion facing in the direction of the current direction of electron acceleration is impressed with a voltage potential effective to deflect injected electrons towards the main electron orbit. Further still, at each moment of time, the electrode in the direction opposite the direction of the acceleration can be impressed with a high voltage potential to prevent electrons from entering the region of the main electron orbit. A power supply coupled to the first portion and to the second portion can be synchronized with the cyclical magnetic field whereby the deflected electrons travel in a direction of electron acceleration.

According to another embodiment of the invention, a method for injecting electrons into an evacuated toroidal passageway having a main electron orbit located therein. The method includes intersecting the passageway with a magnetic flux that repeatedly cycles from increasing magnetic flux to decreasing magnetic flux. Further, generating electrons from a single cathode location and injecting the electrons towards the main electron orbit twice during each magnetic cycle in a direction of electron acceleration.

According to an aspect of the invention, the method can include the step of disposing a first electrode and a second electrode within the toroidal passageway wherein a combination of the first electrode and the second electrode define a central space having a first opening and a second opening. The method may further include positioning the single cathode location within the central space. The method can also include the steps of positioning the first electrode adjacent the main electron orbit and coupling the first electrode to ground. The method can include coupling the second electrode to a power supply that generates a voltage potential effective to deflect injected electrons towards the main electron orbit.

According to an aspect of the invention, the method can include a switch that effectively enables the high voltage power supply to provide voltages to the bi-directional cathode at a selected time shortly after the cyclical magnetic field changes sign. Also, the method can include locating a first suppression-deflection electrode proximate the first opening and locating a second suppression-deflection electrode proximate the second opening.

According to an aspect of the invention, the method can include a power supply that is effective to selectively apply a voltage potential to one of the first suppression-deflection electrode and the second suppression-deflection electrode. It is possible the voltage deflection deflects or suppresses electrons traveling opposite a direction of acceleration of the main electron orbit. Further, the method can include the single electron source that is selected to be a bi-directional dispenser. Further still, the method can include the second electrode divided into a first portion adjacent the first opening and a second portion adjacent the second opening and the first portion and the second portion are electrically isolated. Finally, the method can include impressing a voltage potential effective to deflect electrons toward the main electron orbit on only that one of the first portion and the second portion aligned with a direction of electron acceleration.

Further features and advantages of the invention will become more readily apparent from the following detailed description when taken in conjunction with the accompanying Drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein:

FIG. 3A is a bi-directional dispenser cathode; FIG. 3B is a point electron source cathode; FIG. 3C is a two-sided carbon nanotube emitter; and FIG. 3D is a cold cathode emitter with double side construction and a bi-directional dispenser cathode;

DETAILED DESCRIPTION OF THE PREFERRED EMBODIMENTS

Figure 1:
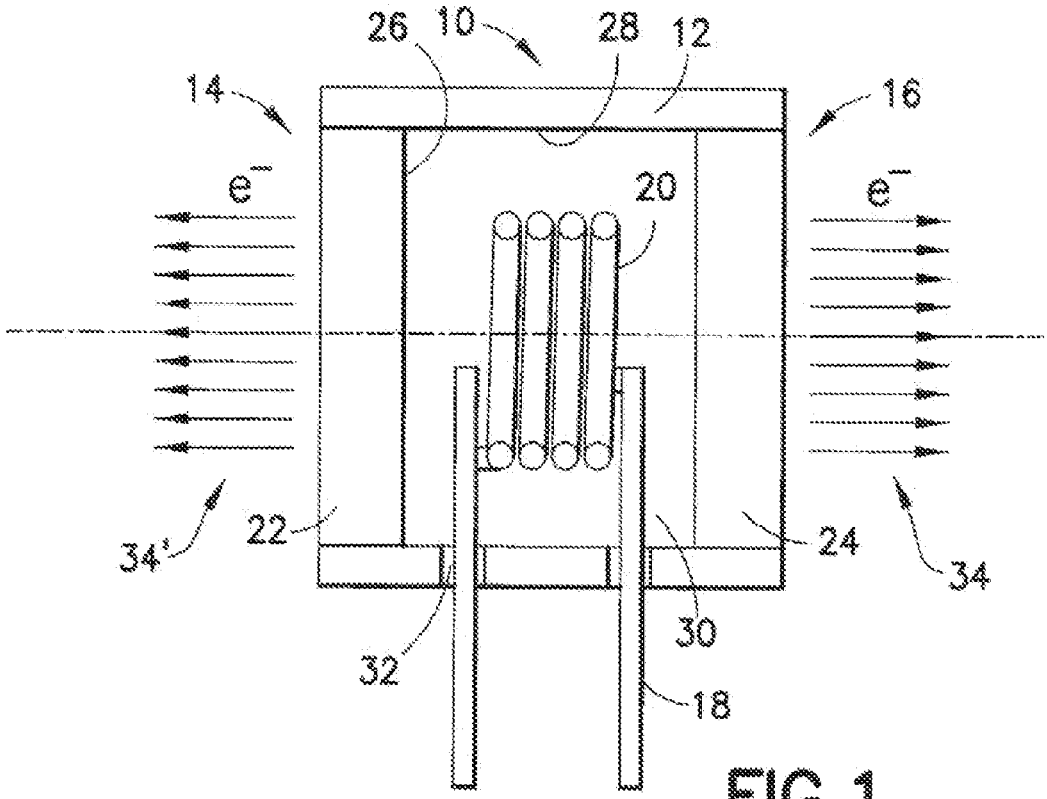
FIG. 1 illustrates a bi-directional dispenser cathode as described in commonly owned U.S. patent application Ser. No. 11/957,183.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice. Further, like reference numbers and designations in the various drawings indicated like elements.

According to an embodiment of the invention, the invention has a Betatron including a toroidal passageway disposed in a cyclical magnetic field varying between a maximum positive value and an opposite negative value with a main electron orbit circumnavigating the toroidal passageway. The negative and positive amplitudes can be equal or very similar to assure that the energy of the accelerated electron beam is virtually the same in both directions. Within the toroidal passageway can be a first electrode that is spaced apart from a second electrode. The combination of the first electrode and the second electrode define a central space having a first opening that can be at one end and a second opening that can be at an opposing second end. However, it is noted that the first and second openings can be positioned in varying arrangements other than discussed above. A cathode can be disposed within the central space. This cathode has a first electron emitter aligned to inject electrons through the first opening and a second electron emitter aligned to inject electrons through the second opening. Electrons injected in the direction of the accelerating EMF are accelerated in the main electron orbit. At a time of maximum electron acceleration, the electrons are deflected and impact a target. The deceleration of the electrons in the target results in the emission of x-rays.

The system and apparatus described herein may be used with an emitter capable of injecting electrons into an accelerator in more than one direction. Such emitters include a two-sided carbon nanotube emitter design or similar point electron source, a cold cathode emitter with double sided construction, and a bi-directional dispenser cathode, such as that disclosed in U.S. patent application Ser. No. 11/957,183.

The emitter could also can be a single surface, from which the beam is split into two directions. One accelerator enhanced by this system and apparatus is a Betatron which is a high energy source of x-ray radiation.

By employing a bi-directional cathode in a Betatron driven by a bi-directional current flow, and appropriately timing the high voltage pulse applied to the cathode, electrons can be injected into the accelerating and confining magnetic field of each half cycle. This in effect doubles the radiative efficiency of the device by making full use of each part of the operating cycle and leads to a doubling of the achievable x-ray output of the device at almost the same power consumption.

Among the advantages of using a single, two-faced, cathode are: (1) in the case of a dispenser cathode, there is only a single heating element and the power dissipation for heating the cathode is virtually unchanged from the single face cathode; (2) the single pulsing source using a single feed-through into the vacuum can provide injection in both directions; and (3) the number of feed-throughs required is unchanged from the single face cathode approach. The dual deflection electrodes can be powered through a single feed-through by using a deflection voltage that is adjusted for each half cycle.

FIG. 1 illustrates a bi-directional dispenser cathode 10 as described in U.S. patent application Ser. No. 11/957,183. The dispenser cathode 10 has a body 12 with at least a first open end 14 and a second open end 16. Leads 18 extend through a wall of the body 12 to provide power to heater coil 20. A first electron emitter 22 spans the first open end 14 and a second electron emitter 24 spans the second open end 16 such that inward facing surfaces 26 of the electron emitters and interior walls 28 of the body 12 define an interior volume that contains heater coil 20.

The body 12 is formed from a metal that resists deformation at high temperatures, such as refractory metal, and is preferably molybdenum. The heater coil 20 is inserted into the interior volume of the body 12 and embedded in a ceramic matrix 30 formed from an electrically insulating material such as Alumina. The leads 18 extend through a wall of the body 12 and are electrically isolated from the body by dielectric 32. The leads 18 are electrically interconnected to a power supply capable of providing a current effective for the heater coil 20 to reach an effective elevated temperature on the order of 900° C. or more. When the heater coil 20 is formed from a rhenium tungsten alloy, a nominal current of 2.5 amps or more is effective to generate the required temperature.

The first 22 and second 24 electron emitters are formed from a material effective to emit electrons when heated. One such mixture is a porous tungsten matrix doped with a material effective to lower the work function, such as barium calcium aluminate. When the emitters are heated to a temperature of 900° C. or more, electrons 34, 34' are emitted.

Figure 2:
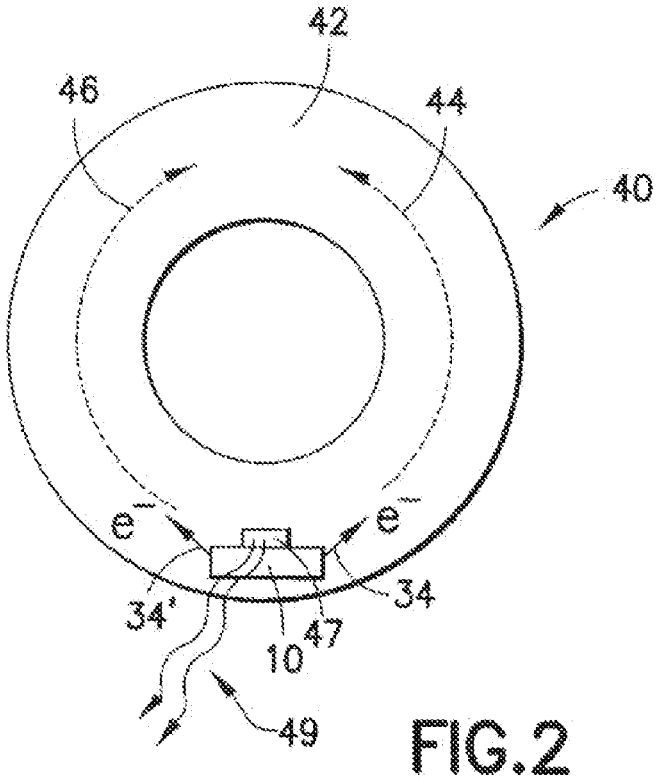
FIG. 2 illustrates the bi-directional dispenser cathode of FIG. 1 disposed in a teroidal vacuum chamber of a Betatron.

FIG. 2 illustrates a portion 40 of a Betatron utilizing the bi-directional dispenser cathode 10. The betatron includes an evacuated toroidal passageway 42 that is intersected by a cyclically changing magnetic field. The injection from a single location cathode, such as bi-directional dispenser cathode 10, is synchronized with the Betatron magnet coil such that electrons are injected into the evacuated toroidal passageway 42 twice during each magnetic cycle, as the magnetic field begins to increase from zero and as the magnetic field begins to decrease below zero. Electrons 34 are injected into the passageway 42 and circumscribe the passageway 42. The electrons are accelerated along a main electron orbit in a first direction 44 as an increasing positive current in the magnet coils generates an increasing magnetic field and accelerating EMF. At about the moment of maximum positive voltage/maximum magnetic field, the electrons are deflected to target 47. On impact with the target 47, x-rays are generated. As the voltage begins to decrease and falls below zero, electrons 34' are injected into the passageway 42 and accelerated along the main electron orbit in an opposing second direction 46 as an increasing negative current in the coils of the Betatron magnet generates an increasing magnetic field of opposite polarity and an associated EMF in the opposite direction. At about the moment of maximum negative voltage/maximum opposite magnetic field, the electrons are deflected to target 47.

Still referring to FIG. 2, an AC power supply provides the voltage generating the magnetic field such that the first portion of each cycle accelerates in first direction 44 and the second portion of each cycle accelerates in the second direction 46. At a time of nominal peak magnetic field, the electrons are deflected from the main electron orbit and impact the target 47, such as a tantalum foil, to generate x-rays 49.

Figure 3A:
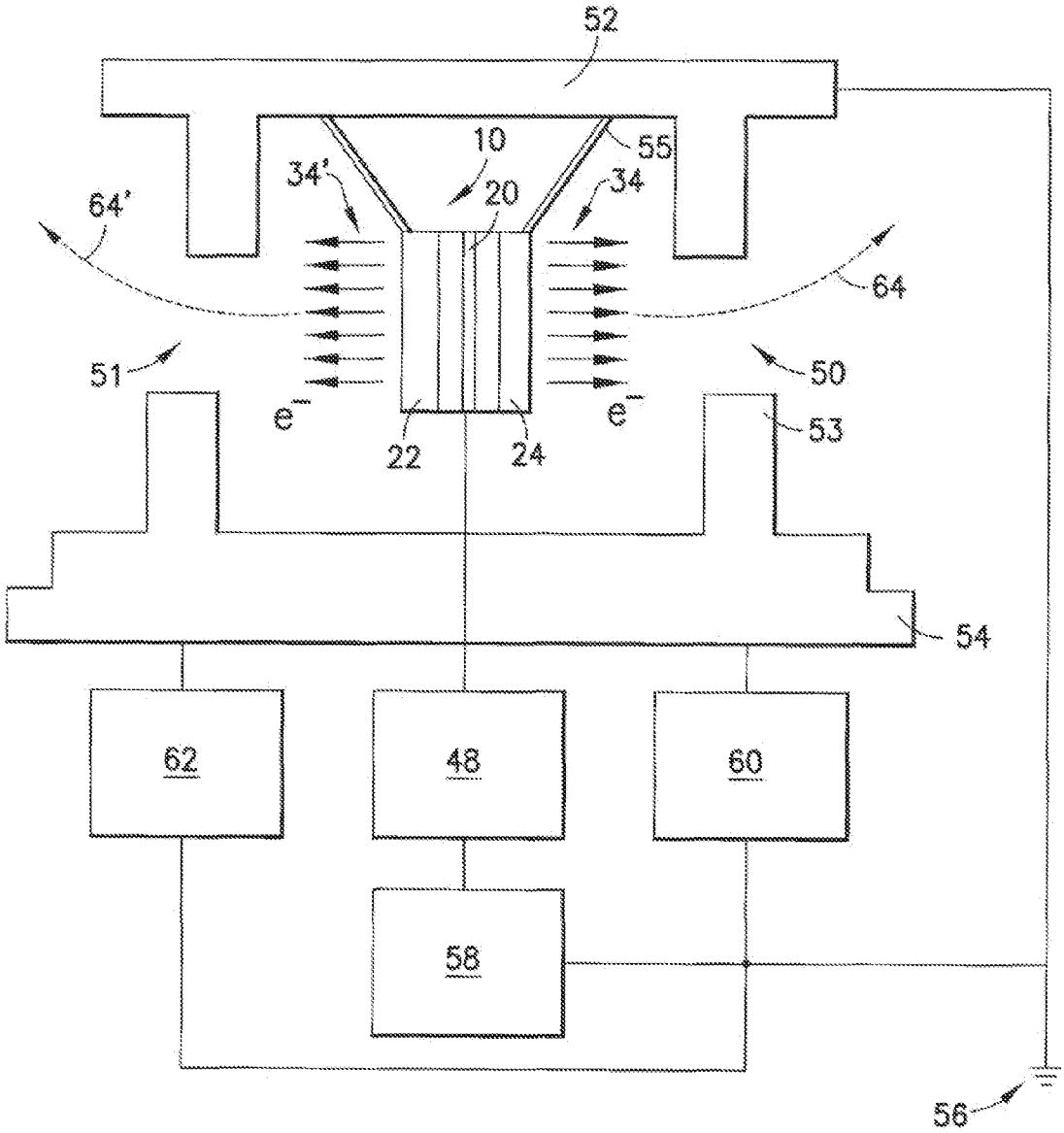
FIGS. 3A-D illustrates embodiments for controlling a flow of electrons from different types of cathodes.
Figure 3B:
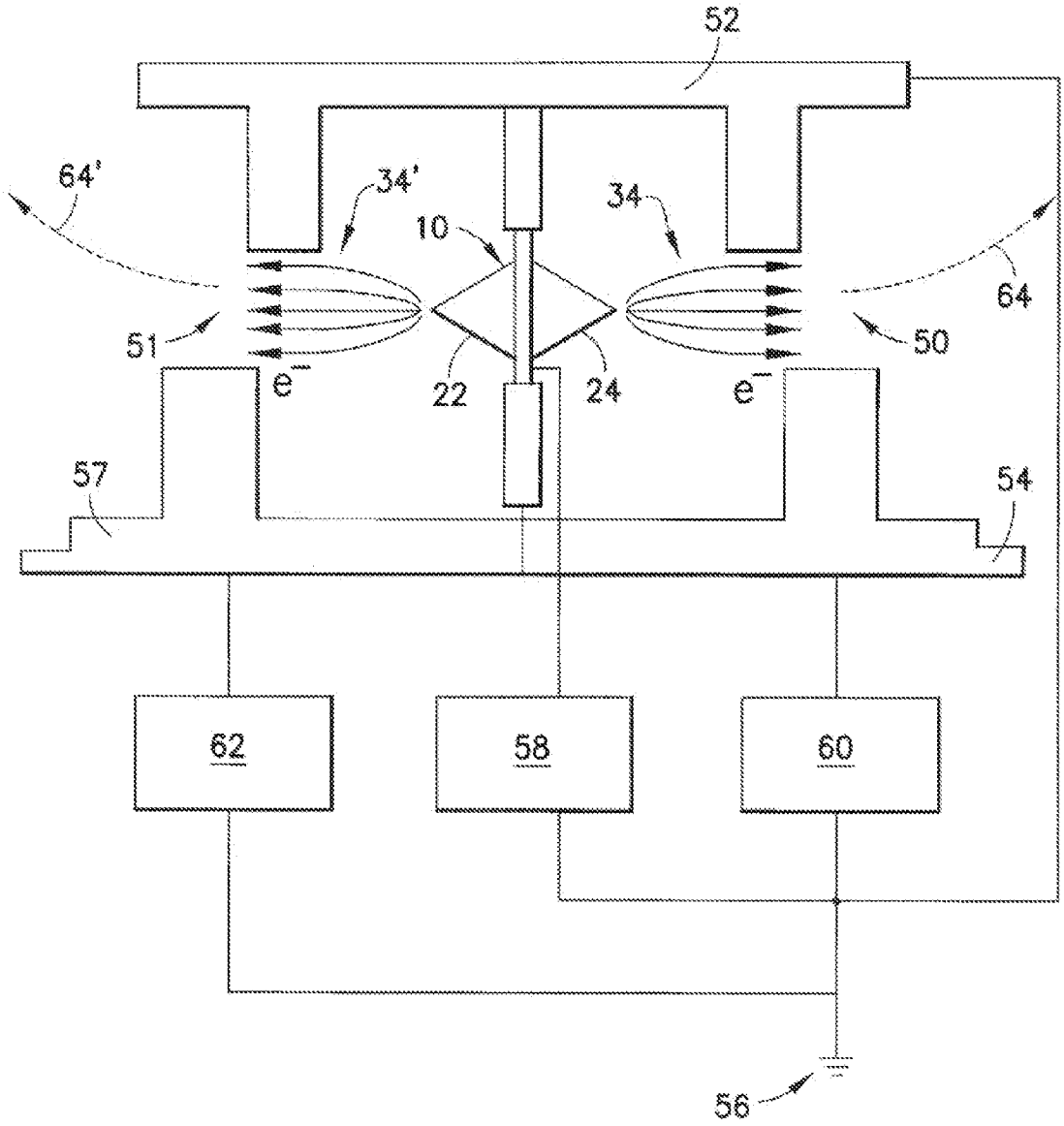
Figure 3C:
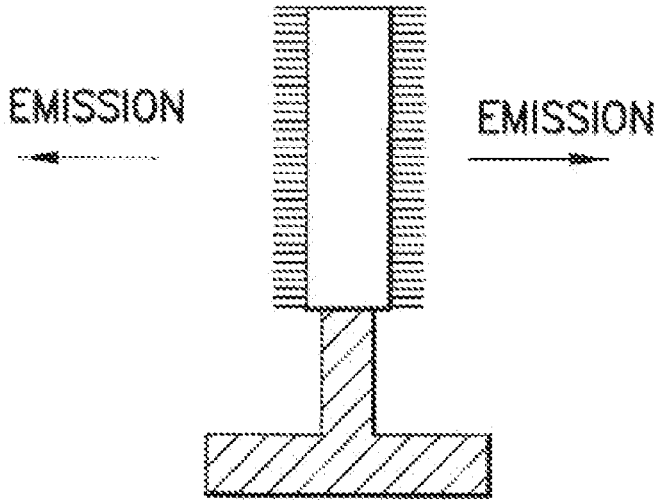
Figure 3D:
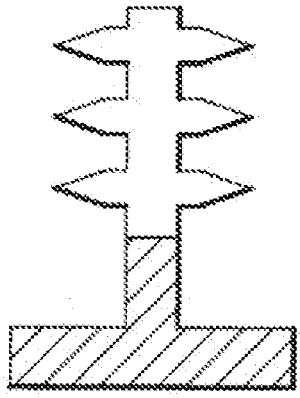

FIGS. 3A-D illustrates embodiments for controlling a flow of electrons from different types of cathodes: FIG. 3A is a bi-directional dispenser cathode; FIG. 3B is a point electron source cathode; FIG. 3C is a two-sided carbon nanotube emitter; and FIG. 3D is a cold cathode emitter with double side construction and a bi-directional dispenser cathode. For example, FIG. 3A illustrates a first embodiment for controlling the flow of electrons 34, 34' emitted by bi-directional dispenser cathode 10. A hot cathode power supply 48 provides the Ser. No. 11/957,228 current necessary for heater coil 20 to heat first 22 and second 24 electron emitters to a temperature effective to emit electrons. A switch enables the power supply 58 to provide high voltage pulses to the bi-directional dispenser cathode 10 immediately after the magnetic field has changed sign, nominally a few microseconds after, each cyclic change in magnetic field direction. The cathode 10 is disposed within a central space that is defined by a first electrode 52 and a second electrode 54. The central space terminates at opposing first opening 50 and second opening 51. Faces of the first electron emitter 22 and second electron emitter 24 are aligned so that emitted electrons pass through one of the openings 50, 51 formed by flanges in a ground shield (first) electrode 52 and a deflection (second) electrode 54. The ground shield electrode 52 is coupled to ground 56 to prevent disrupting the flow of electrons either from the bi-directional dispenser cathode 10 or in the main electron orbit of the Betatron. High voltage power supplies 60 and 62 provide a biasing (positive or negative voltage potential) to the deflector electrode 54 that is effective to deflect electron stream 64, 64' in the direction of the main electron orbit. A potential relative to ground from about negative several hundred volts to about positive 600 volts is impressed at deflection electrodes 53. In this first embodiment, electrons 34, 34' are injected in both directions during every half magnetic cycle. The electrons injected in the undesired direction, that is the direction opposite the direction of electrons being accelerated by the changing magnetic field, are deflected outwards by the Betatron's magnetic field and terminate by hitting a wall of the vacuum chamber. The electrons injected in the desired direction, in the direction of acceleration, are accelerated and then deflected to impact a target and generate x-rays. FIG. 3B is a point electron source cathode which would replace the bi-directional dispenser cathode 10 in FIG. 3A. FIG. 3C is a two-sided carbon nanotube emitter which would replace the bi-directional dispenser cathode 10 in FIG. 3A. FIG. 3D is a cold cathode emitter with double side construction and a bi-directional dispenser cathode that would replace the bi-directional dispenser cathode 10 in FIG. 3A.

Figure 4:
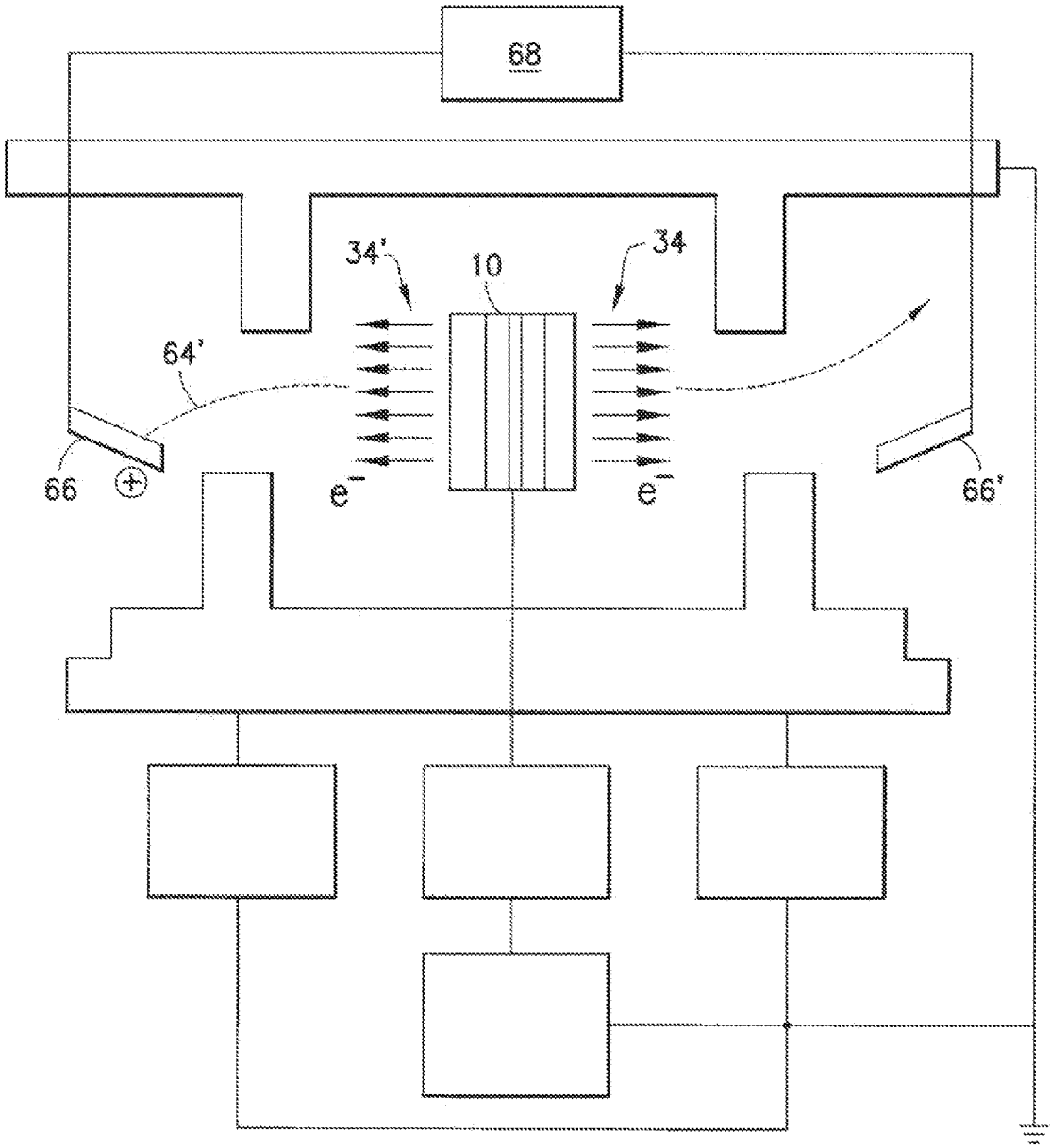
FIG. 4 illustrates a second embodiment for controlling a flow of electrons from the bi-directional dispenser cathode of FIG. 1.

FIG. 4 illustrates a second embodiment for controlling the flow of electrons 34, 34' from bi-directional dispenser cathode 10 that avoids the absorption of electrons by impact with a wall of the vacuum chamber. Electrostatic deflection or suppression is achieved by a suppression or deflection electrode 66, 66' or a reverse bias grid located proximate the openings 50, 51 and powered by biasing power supply 68, that may be a single power unit or separate units for each suppression-deflection electrode.

When in a suppression mode, the electrode 66 is impressed with either a positive voltage potential relative to ground, or is at ground, such that electron stream 64' is terminated at the electrode. When in a deflection mode, the electrode 66 is impressed with any voltage effective to deflect the stream of electrons 46' away from the main electron orbit. Electron stream 64' that is flowing in the undesired direction may also be terminated by a reverse bias grid 66 that is impressed with a positive voltage potential by the biasing power supply 68 or is at ground. The biasing power supply 68 is synchronized with the Betatron power supply such that the electrode or reverse bias grid 66, 66' in the undesired direction during each half magnetic cycle has a voltage potential effective to terminate or deflect electrons flowing in the undesired direction.

Figure 5:
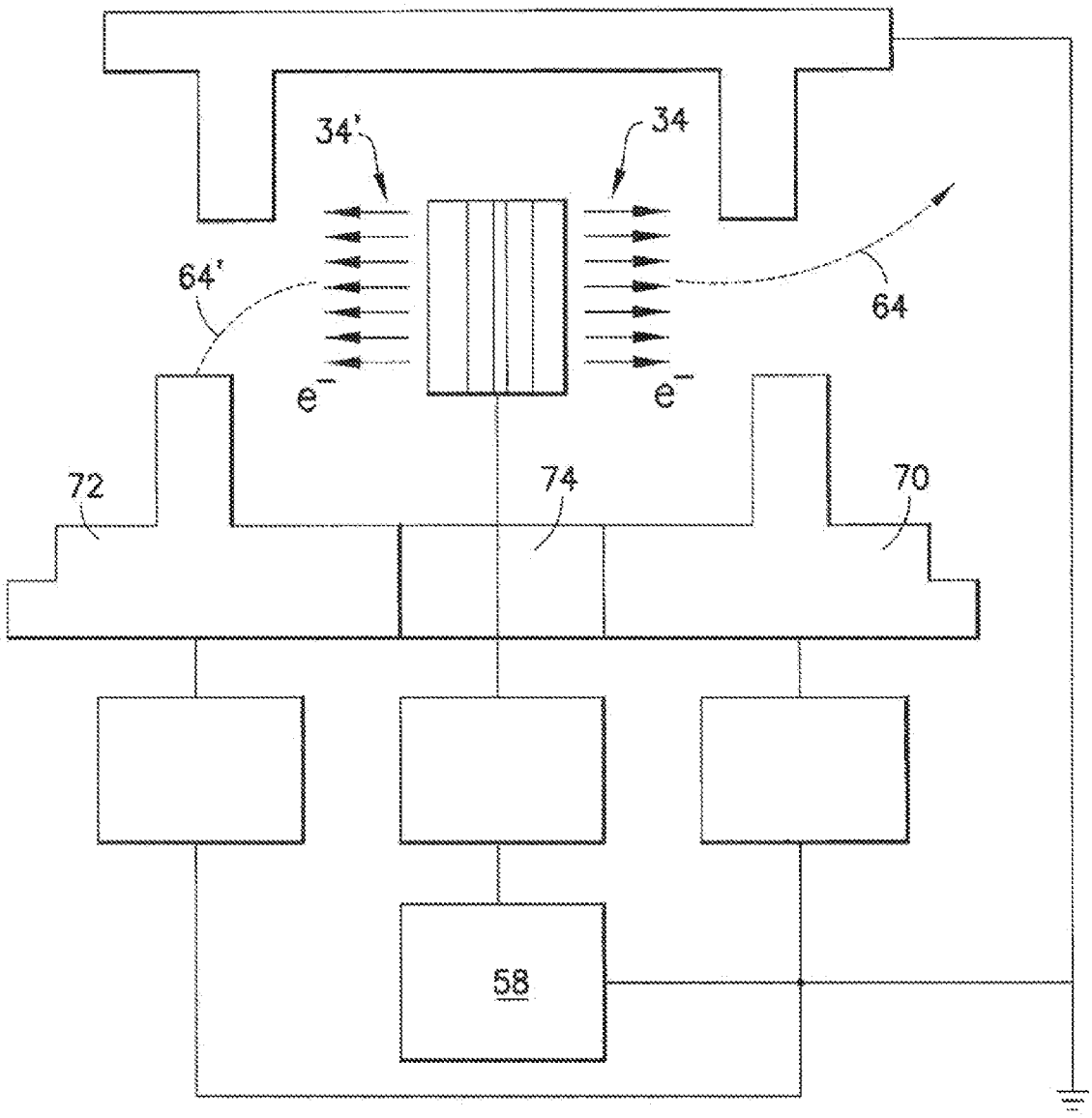
FIG. 5 illustrates a third embodiment for controlling a flow of electrons from the bi-directional dispenser cathode of FIG. 1.

A third embodiment for controlling the flow of electrons 34, 34' is illustrated in FIG. 5. The deflection electrode is divided into a first deflection electrode portion 70 and second deflection electrode portion 72 separated by an electrically isolating dielectric 74. With this embodiment, the high voltage power supply 58 applies a biasing pulse alternately to either the first portion 70 or the second portion 72 such that electron stream 64 is selectively deflected in the desired direction to add electrons flowing in the proper direction to the electron orbit. The electron stream 64' in the direction opposite the accelerating direction may be suppressed or deflected. High voltage power supply 58 can be synchronized with the Betatron cyclical magnetic field to maximize the number of electrons injected into the main electron orbit in the accelerating direction.

Figure 6:
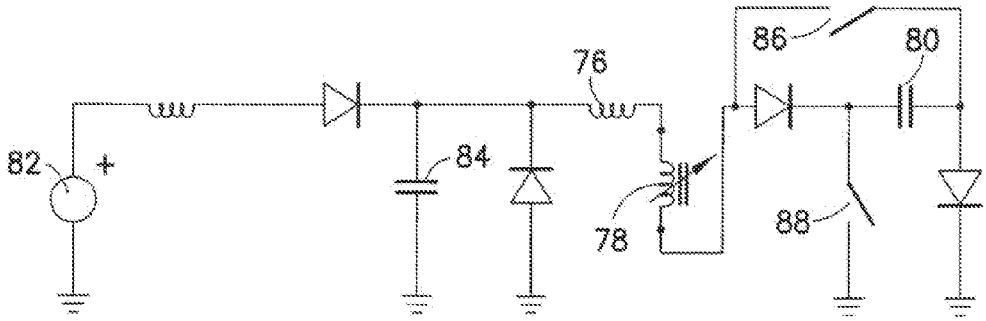
FIG. 6 schematically illustrates an oscillating circuit for providing a changing magnetic flux to the coils of a Betatron.
Figure 7:
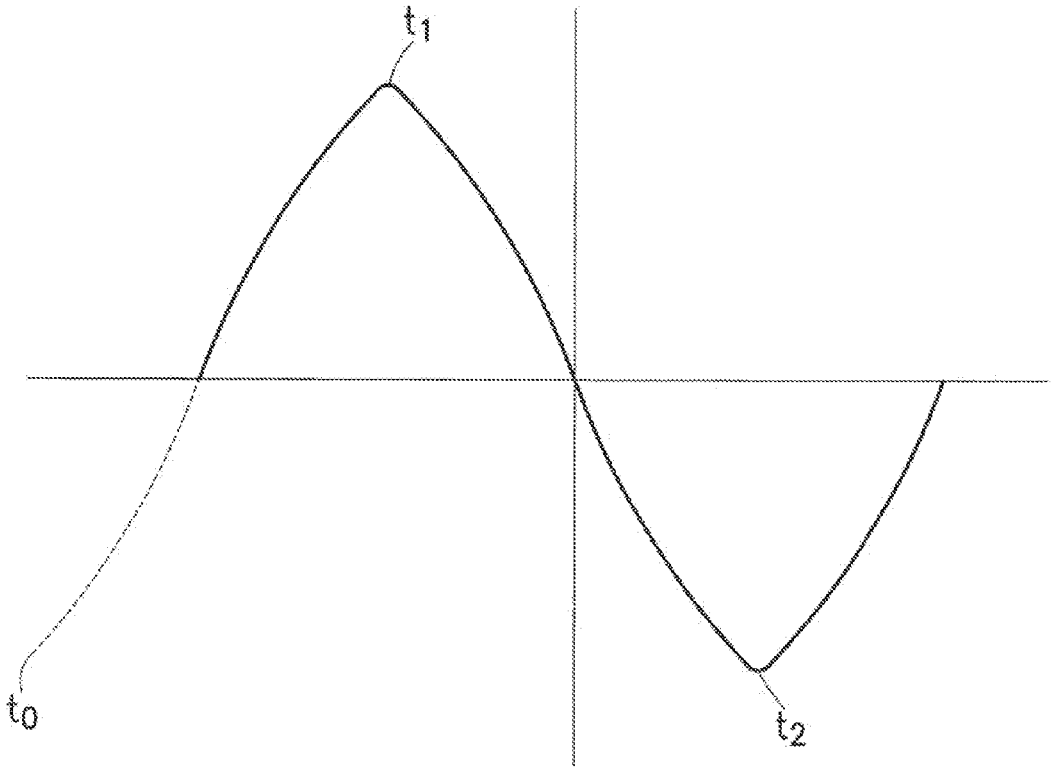
FIG. 7 graphically illustrates a voltage cycle applied to the coils of a Betatron by the oscillating circuit of FIG. 6.

FIG. 6 schematically illustrates an oscillating circuit for providing a changing magnetic flux to the coils 76 of a Betatron. Relatively large currents are usually needed to generate the requisite magnetic field. For efficiency reasons, among others, a tank circuit is employed where energy oscillates between inductive components 76, 78 and capacitive component 80. With reference to FIG. 7, in this scenario, as the energy oscillates, the alternating current induces an alternating magnetic field reversing direction on every half cycle. That is the magnetic field increases and the electrons accelerate in a first direction from time $t_0$ to time $t_1$. The magnetic field increases in the opposing direction and the electrons are accelerated in the opposing direction from time $t_1$ to time $t_2$. As described in commonly owned U.S. patent application Ser. No. 11/854,267 the oscillating circuit includes a low voltage direct current power supply 82, the low voltage capacitor 80, a high voltage capacitor 84 and the Betatron coil 76. The capacitance of the low voltage capacitor 80 is much greater than the capacitance of the high voltage capacitor 84, nominally on the scale of 100 times greater. The Betatron coils 76 have a first inductance and are coupled in an LC oscillating relationship between the low voltage capacitor 80 and the high voltage capacitor 84. The Betatron coils form a portion of the L component of the LC circuit. High voltage storage capacitor 84 forms the C component. When switches 86, 88 are closed, a current starts flowing to the Betatron coils 76. A variable inductor 78 in series (or parallel) with Betatron coils 76 controls the timing by adjusting the inductive L of the coils and thus the time constant of the LC circuit. This time constant is given by the equation:

$$\tau_{LC}=\sqrt{(L+L_{\mathrm{TUNE}})C} \quad (1)$$

The timing of the suppression voltage applied to the suppression-deflection electrode (66 in FIG. 4) or first or second portion (70, 72 in FIG. 5 is synchronized with the timing of the oscillation of the LC circuit to minimize the number of electrons injected in a direction opposite the accelerating electrons.

One or more embodiments of the present invention have been described. Nevertheless, it will be understood that various modifications may be made without departing from the spirit and scope of the invention. It is noted that the foregoing examples have been provided merely for the purpose of explanation and are in no way to be construed as limiting of the present invention. While the present invention has been described with reference to an exemplary embodiment, it is understood that the words, which have been used herein, are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A Betatron having a toroidal passageway disposed in a cyclical magnetic field with a main electron orbit circumnavigating said toroidal passageway, said Betatron comprising:

a first electrode spaced apart from a second electrode defining a central space having a first opening and a second opening;

a cathode disposed within said central space such that a first electron emitter is aligned to inject electrons through said first opening and a second electron emitter is aligned to inject electrons through said second opening; and a target effective to generate x-rays when impacted by accelerated electrons.

2. The Betatron of claim 1, wherein said first electrode is adjacent said main electron orbit and at ground voltage potential.

3. The Betatron of claim 2, wherein said second electrode is at a voltage potential effective to deflect said injected electrons toward said main electron orbit.

4. The Betatron of claim 3, wherein said cathode is selected from the group consisting of a point electron source, a two-sided carbon nanotube emitter, a cold cathode emitter with double side construction and a bi-directional dispenser cathode.

5. The Betatron of claim 4, wherein said cathode is coupled to a high voltage power supply.

6. The Betatron of claim 5, wherein said high voltage power supply is pulsed and said pulsing is synchronized with the cyclical magnetic field.

7. The Betatron of claim 6, wherein a switch effectively enables said high voltage power supply to provide voltages to said bi-directional cathode at a selected time shortly after said cyclical magnetic field changes sign.

8. The Betatron of claim 3, wherein a first suppression electrode is proximate to said first opening and a second suppression electrode is proximate to said second opening.

9. The Betatron of claim 8, wherein said first suppression-deflection electrode and said second suppression-deflection electrode are coupled to a power supply that is synchronized with said cyclical magnetic field.

10. The Betatron of claim 9, wherein one of said first suppression-deflection electrode and said second suppression-deflection electrode are impressed with a voltage potential effective to suppress electrons injected through a proximate opening.

11. The Betatron of claim 5, wherein the voltage from said high voltage supply is constant during each half-cycle.

12. The Betatron of claim 3, wherein said second electrode has a first portion adjacent said first opening and a second portion adjacent said second opening and said first and second portions are electrically isolated.

13. The Betatron of claim 12, wherein, at each moment of time, only the one of said first portion and said second portion facing in the direction of the current direction of electron acceleration is impressed with a voltage potential effective to deflect injected electrons towards said main electron orbit.

14. The Betatron of claim 13, wherein at each moment of time, the electrode in the direction opposite the direction of the acceleration is impressed with a high voltage potential to prevent electrons from entering the region of the main electron orbit.

15. The Betatron of claim 14, wherein a power supply coupled to said first portion and to said second portion is synchronized with said cyclical magnetic field whereby said deflected electrons travel in a direction of electron acceleration.

16. A method for injecting electrons into an evacuated toroidal passageway having a main electron orbit located therein, comprising the steps of:

intersecting said passageway with a magnetic flux that repeatedly cycles from increasing magnetic flux to decreasing magnetic flux;

generating electrons from a single cathode location; and injecting said electrons towards said main electron orbit twice during each magnetic cycle in a direction of electron acceleration.

17. The method of claim 16, including the step disposing a first electrode and a second electrode within said toroidal passageway wherein a combination of said first electrode and said second electrode define a central space having a first opening and a second opening; and positioning said single cathode location within said central space.

18. The method of claim 17, including the steps of positioning said first electrode adjacent said main electron orbit and coupling said first electrode to ground; and coupling said second electrode to a power supply that generates a voltage potential effective to deflect injected electrons towards said main electron orbit.

19. The Betatron of claim 18, wherein a switch effectively enables said high voltage power supply to provide voltages to said bi-directional cathode at a selected time shortly after said cyclical magnetic field changes sign.

20. The method of claim 19, further including locating a first suppression-deflection electrode proximate said first opening and locating a second suppression-deflection electrode proximate said second opening.

21. The method of claim 20, wherein a power supply is effective to selectively apply a voltage potential to one of said first suppression-deflection electrode and said second suppression-deflection electrode.

22. The method of claim 21, wherein said voltage deflection deflects or suppresses electrons traveling opposite a direction of acceleration of said main electron orbit.

23. The method of claim 22, wherein said single electron source is selected to be a bi-directional dispenser.

24. The method of claim 18, wherein said second electrode is divided into a first portion adjacent said first opening and a second portion adjacent said second opening and said first portion and said second portion are electrically isolated.

25. The method of claim 24, including impressing a voltage potential effective to deflect electrons toward said main electron orbit on only that one of said first portion and said second portion aligned with a direction of electron acceleration.

* * * * *